US011819986B2

(12) United States Patent
Ogrodnick

(10) Patent No.: US 11,819,986 B2
(45) Date of Patent: Nov. 21, 2023

(54) DRAIN EXTRACTOR TOOL

(71) Applicant: Michael John Ogrodnick, Edgeley (CA)

(72) Inventor: Michael John Ogrodnick, Edgeley (CA)

( * ) Notice: Subject to any disclaimer, the term of this patent is extended or adjusted under 35 U.S.C. 154(b) by 0 days.

(21) Appl. No.: 17/862,921

(22) Filed: Jul. 12, 2022

(65) Prior Publication Data

US 2023/0013633 A1 Jan. 19, 2023

Related U.S. Application Data

(60) Provisional application No. 63/221,982, filed on Jul. 15, 2021.

(51) Int. Cl.
*B25B 27/14* (2006.01)
*A47K 17/00* (2006.01)

(52) U.S. Cl.
CPC ..... *B25B 27/14* (2013.01); *A47K 17/00* (2013.01)

(58) Field of Classification Search
None
See application file for complete search history.

(56) References Cited

U.S. PATENT DOCUMENTS 1,643,638 A * 9/1927 Dunham ..... B25B 27/14 81/448
2,052,304 A * 8/1936 Kaplan ..... B25B 27/062 29/262
2,689,497 A * 9/1954 Oberwegner ..... B25B 13/50 81/186
3,304,601 A * 2/1967 Torres ..... B25B 27/0028 D8/51
5,946,990 A * 9/1999 Bonacci ..... B27B 21/00 30/502
6,237,168 B1 * 5/2001 Daniel, III ..... A47K 1/14 4/689

* cited by examiner

*Primary Examiner* — Tyrone V Hall, Jr.
*Assistant Examiner* — Dana Lee Poon
(74) *Attorney, Agent, or Firm* — Christopher J. Dynowski; Michael R. Williams; Ade & Company Inc.

(57) ABSTRACT

A device for removing a drain in a basin comprises a pair of legs in parallel spaced relation and on either side of a rotational axis, a bridging member interconnecting the legs which are movably supported thereon, and a coupling member carried on the bridging member and configured for connecting to a rotary hand tool. The legs comprise end portions configured for insertion into the drain, and the end portions comprise outer sides configured to engage an inside wall of the drain. Stabilizers are affixed to the legs and extending outwardly therefrom in opposite directions and configured to rest on a surface interior to the basin when the end portions of the legs are inserted into the drain. A biasing member is carried between the legs and configured to urge them laterally apart to locate the outer sides of the end portions into butting engagement with the inside wall of the drain.

8 Claims, 8 Drawing Sheets

DRAIN EXTRACTOR TOOL

This application claims the benefit under 35 U.S.C. 119(e) of U.S. provisional application Ser. No. 63/221,982, filed Jul. 15, 2021, which is incorporated by reference herein.

FIELD OF THE INVENTION

The present invention relates generally to an adaptive tool that enables a user to extract a drain from a basin.

BACKGROUND

The proper tool for a specific use can produce a higher quality job, save time and money, provide for the increased safety of the worker, and reduce damage to equipment. Plumbing is a specialized field in which very specific tools perform very specific tasks that would otherwise be almost impossible to perform. A task that is commonly performed in many types of plumbing repairs is the removal of a drain flange from basins of tubs, sinks, showers, and the like. Often times, through either use of another tool to remove the drain, or other incidental damage over time, the center nut of these drains is broken, thereby making the removal much more difficult or impossible with conventional tools. Accordingly, there exists a need for a means by which drain flanges from tubs, sinks, showers, and the like can be easily removed without the disadvantages of current methods.

Typically, a liquid-receiving basin has a drain opening for gravitationally releasing liquid from the basin, and there is a drain pipe registered with the drain opening and extending therefrom to guide the liquid away from the basin. The drain, which fluidically interconnects the basin and the drain pipe, comprises a tubular portion configured for inserting into the drain pipe and having a smooth interior wall and a threaded outer wall for threadably connecting to an inside of the drain pipe. The drain further includes a rim portion which forms an annular flange at one end of the tubular portion to bridge and close an annular gap between the drain pipe and the drain opening. Typically, the drain also includes a plug which is supported on a threaded shaft coaxially of the drain's tubular portion on criss-crossing members spanning transversely of the tubular portion. These criss-crossing members are not constructed of a suitable quality to resist a rotational force applied thereto to threadably remove the drain.

SUMMARY OF THE INVENTION

According to an aspect of the invention there is provided a device for removing a drain mounted in a basin, comprising:

- a pair of legs each extending longitudinally from a first end to a second end, wherein the legs are substantially parallel to one another and laterally spaced-apart to be located on either side of a central rotational axis;
- a bridging member oriented crosswise to the rotational axis and extending in a lateral direction to interconnect the legs;
- wherein each of the legs is movably supported on the bridging member at a location thereon spaced from the second end, so as to be movable relative thereto and to one another in the lateral direction;
- a coupling member carried on the bridging member at a location registered with the rotational axis and configured for connecting to a rotary hand tool;

- wherein the legs comprise end portions defining the second ends thereof and configured for insertion into the drain;
- wherein the end portions comprise outer sides each facing away from an opposite one of the legs and configured to engage an inside wall of the drain;
- a plurality of stabilizers attached in fixed relation to the legs and extending outwardly therefrom in opposite directions crosswise to the longitudinal and lateral directions, wherein the stabilizers are configured to rest on a surface interior to the basin when the end portions of the legs are inserted into the drain; and
- a biasing member carried between the legs and configured to urge the legs laterally apart to locate the outer sides of the end portions of the legs into butting engagement with the inside wall of the drain.

This arrangement provides a relatively simple tool for removing or extracting a drain by engaging an inside wall thereof.

Preferably, the legs are slidably movably supported on the bridging member.

In the illustrated arrangement, the bridging member has a polygonal cross-section and each of the legs has an opening sized and shaped to matingly receive the bridging member such that relative rotation between the leg and the bridging member is resisted.

For example, the bridging member has a rectangular-shaped cross-section.

Preferably, the end portions of the legs comprise a plurality of spaced-apart longitudinally-extending ridges configured for gripping the inside wall of the drain.

Preferably, the stabilizers comprise a pair of the stabilizers on each of the legs and projecting in opposite directions therefrom.

In the illustrated arrangement, the biasing member is threadably carried on a first one of the legs for movement relative thereto in the lateral direction to selectively engage an opposite one of the legs.

In such an arrangement, the opposite leg comprises a recess on an inner side thereof facing the first leg and arranged to snugly receive an end of the biasing member to resist relative movement when the biasing member is selectively engaged with the opposite leg.

In the illustrated arrangement, each of the outer sides of the end portions of the legs is convexly rounded between opposite sides of the leg which span between the first and second ends thereof.

According to an aspect of the invention there is provided a drain extracting tool, comprising:

- a first leg, having:
  - a first leg first end and a first leg second end;
  - a first grip located at said first leg second end thereof;
  - a first guide located superjacent said first grip;
  - a pair of first flanges, extending perpendicularly away from said first leg second end; and,
  - a bore located on a first leg first side thereof, superjacent to said first guide;
- a second leg, having:
  - a second leg first end and a second leg second end;
  - a second grip located at said second leg second end thereof;
  - a second guide located superjacent said second grip;
  - a pair of second flanges, extending perpendicularly away from said second leg second end; and,
  - an aperture located superjacent to said second guide and vertically aligned with said bore;

a bridge, wherein said first leg first end and said second leg first end travel thereabout;

a first bolt removably attached to said aperture; and, a second bolt affixed to a center of a top surface of said bridge.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
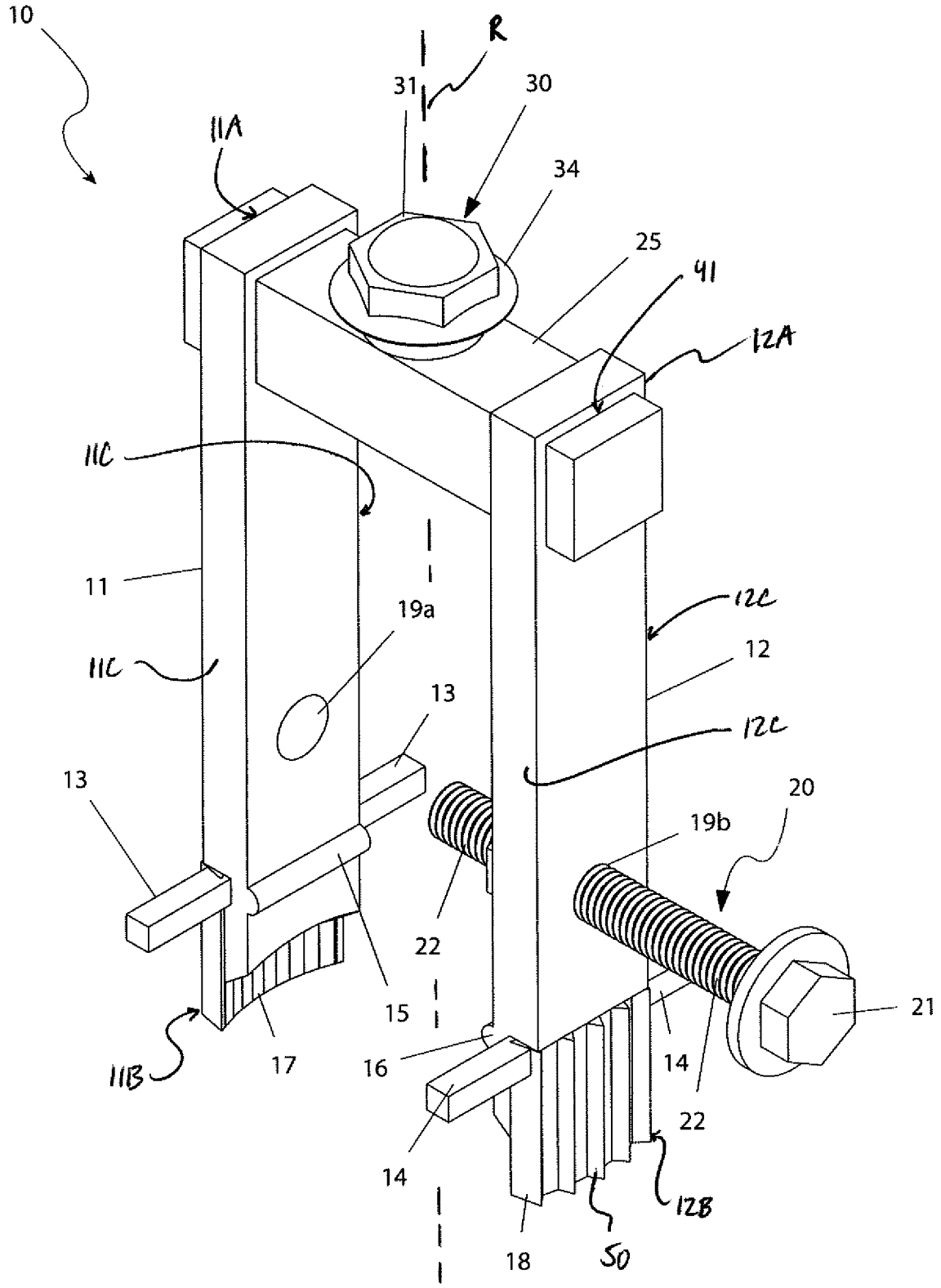
FIG. 1 is a front right perspective view of a drain extractor tool according to the preferred embodiment of the present invention.
Figure 2:
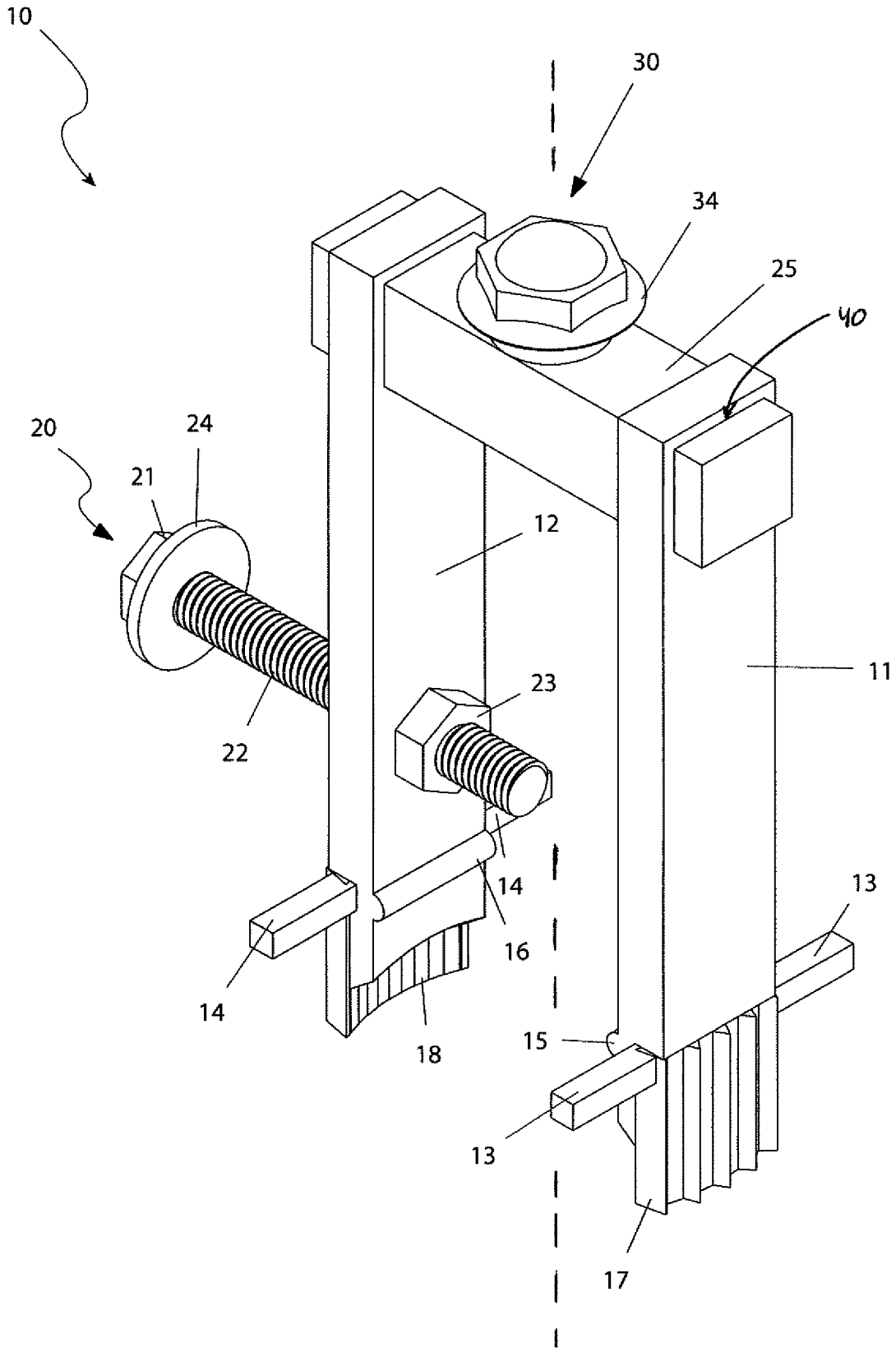
FIG. 2 is a rear left perspective view of the drain extractor tool of FIG. 1.
Figure 3:
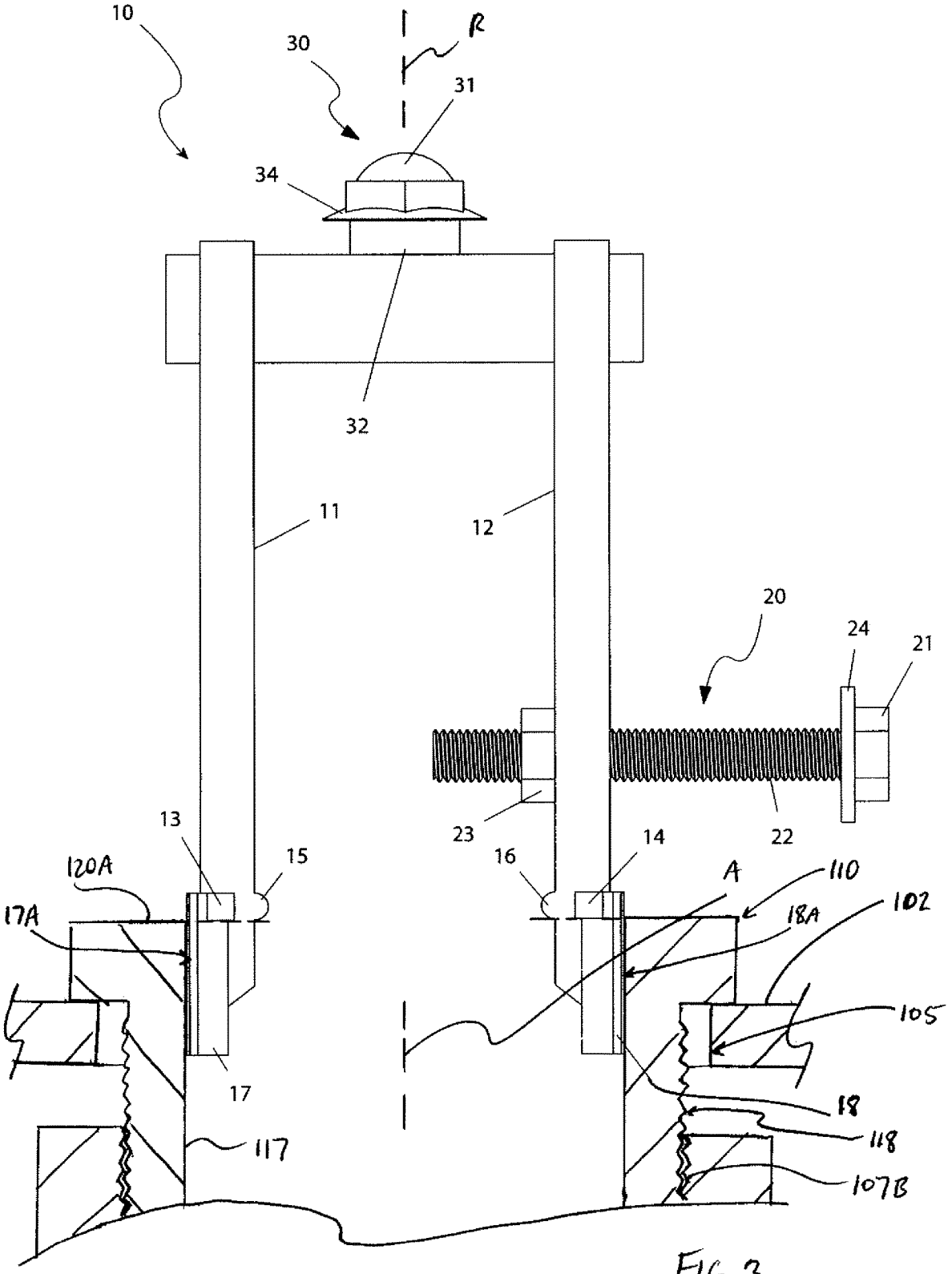
FIG. 3 is a front elevation view of the drain extractor tool of FIG. 1, shown inserted in a drain of a basin (schematically shown in cross-section)
Figure 4:
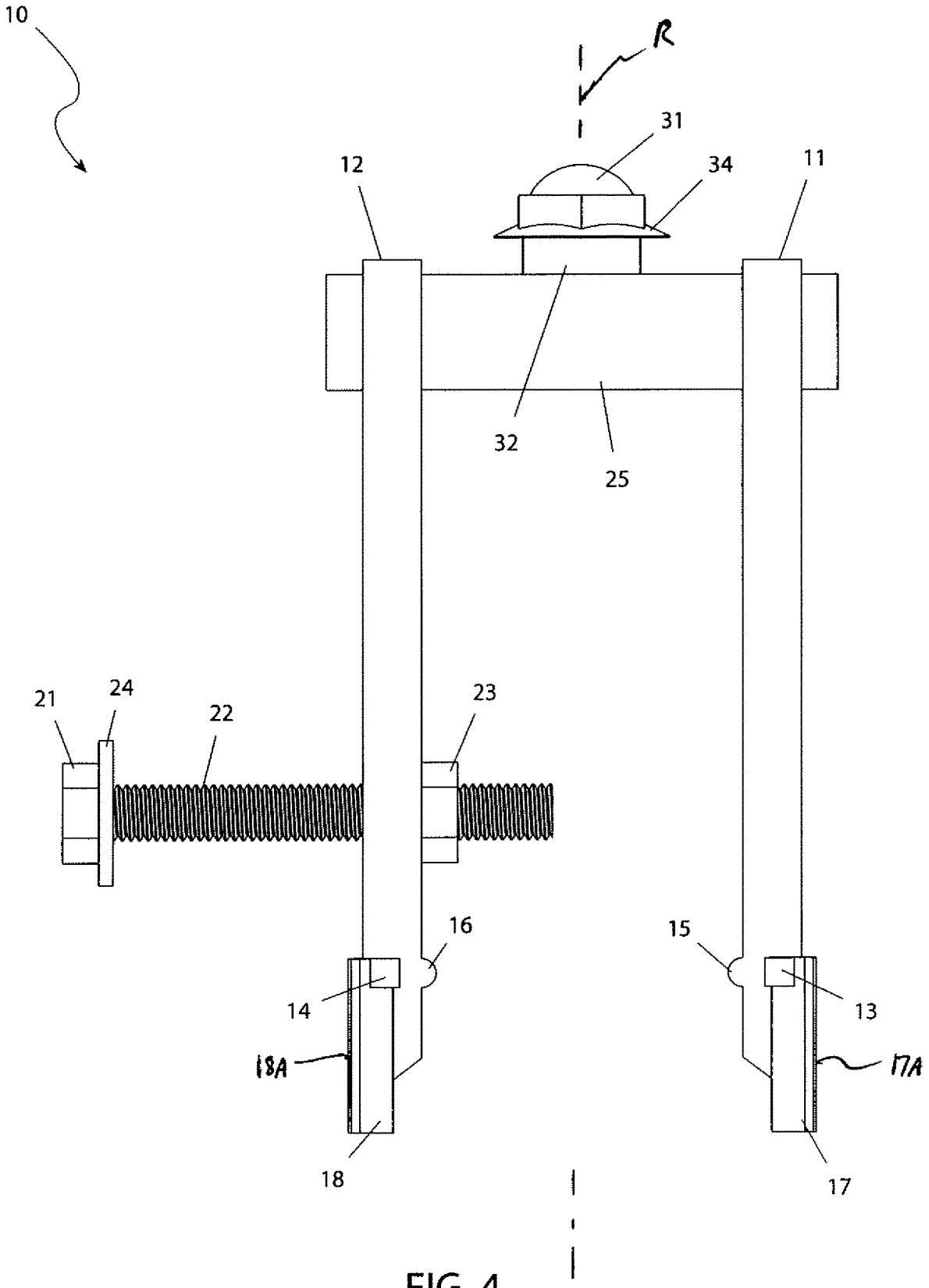
FIG. 4 is a rear elevation view of the drain extractor tool of FIG. 1.
Figure 5:
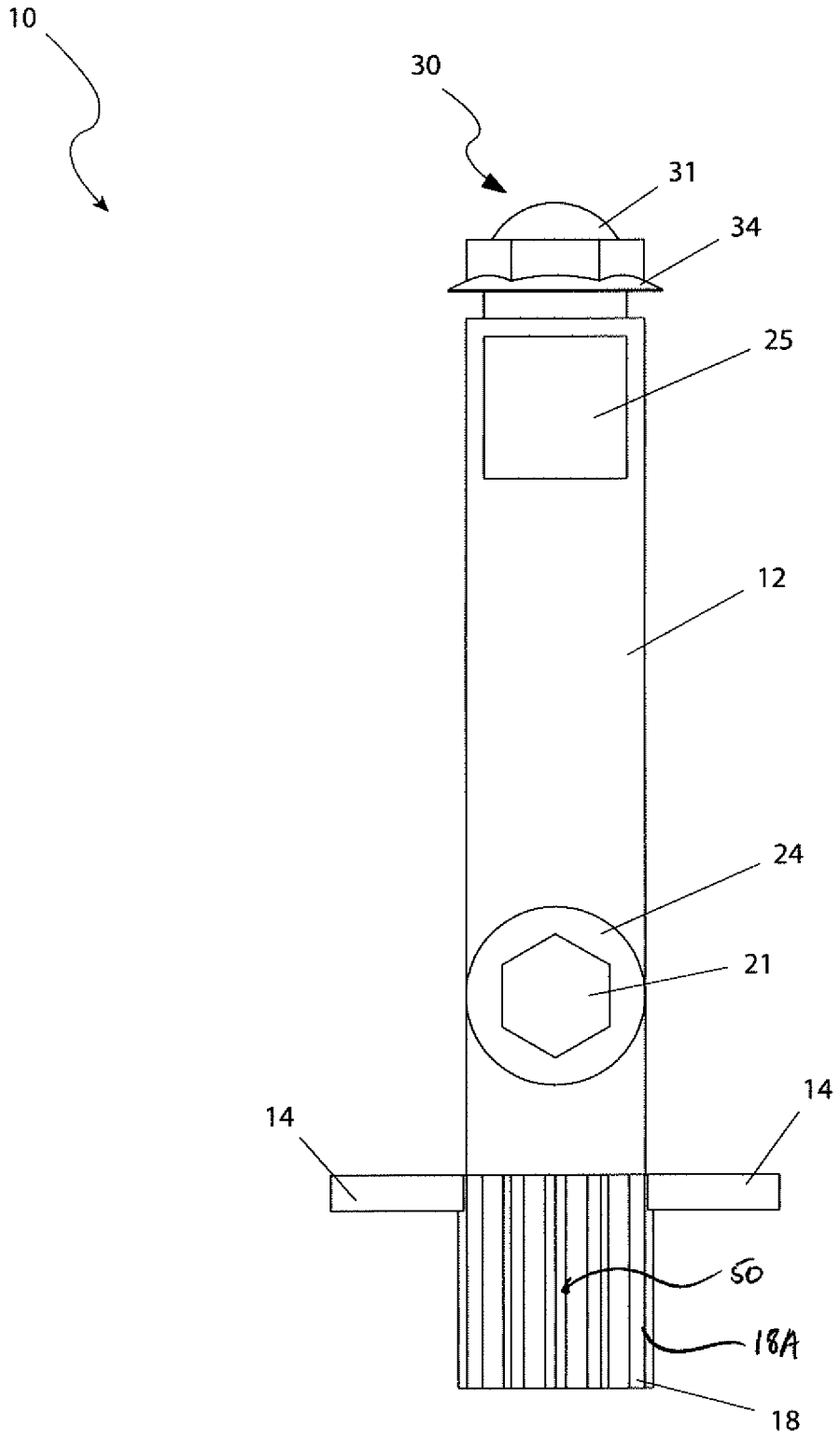
FIG. 5 is a right elevation view of the drain extractor tool of FIG. 1.
Figure 6:
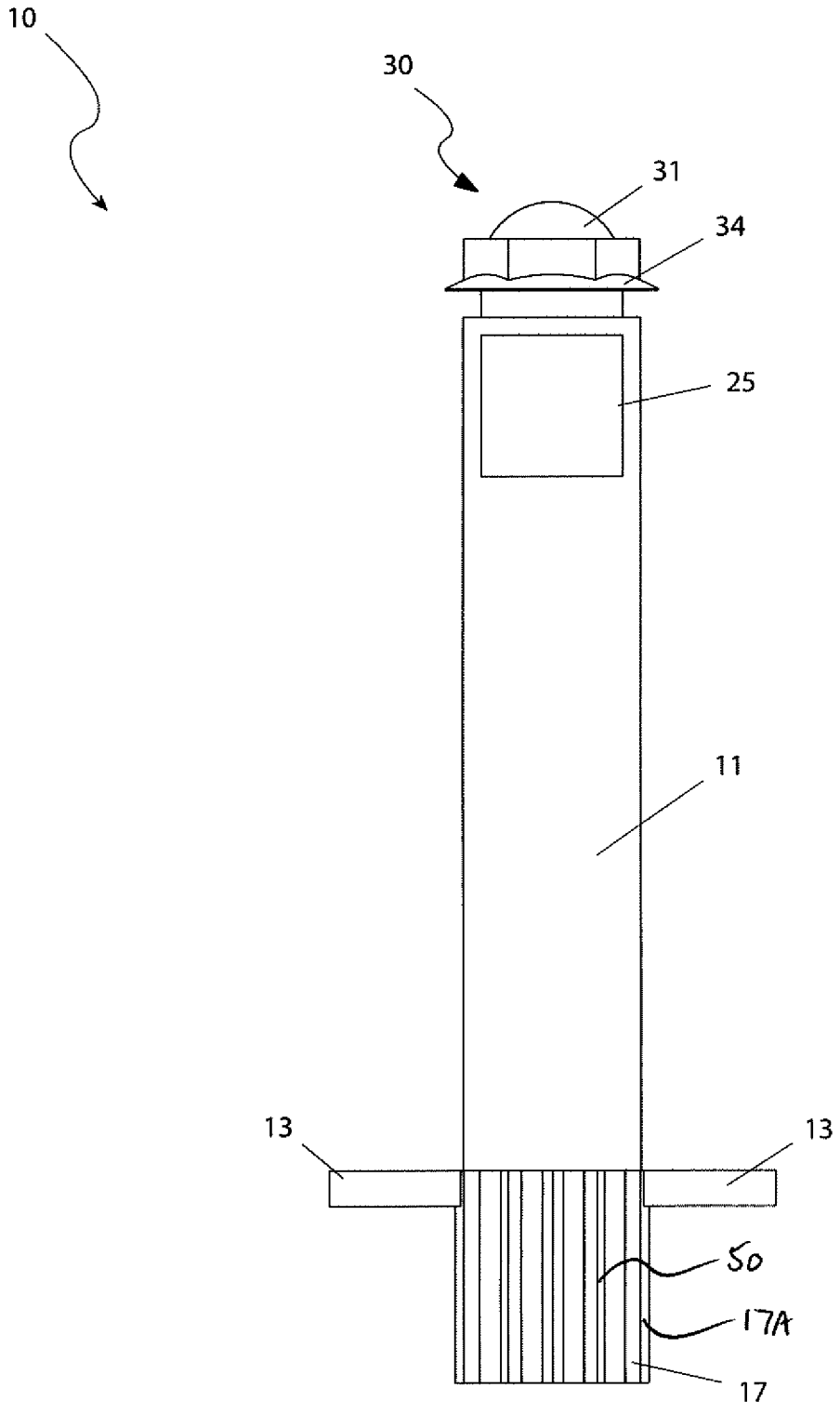
FIG. 6 is a left elevation view of the drain extractor tool of FIG. 1.
Figure 7:
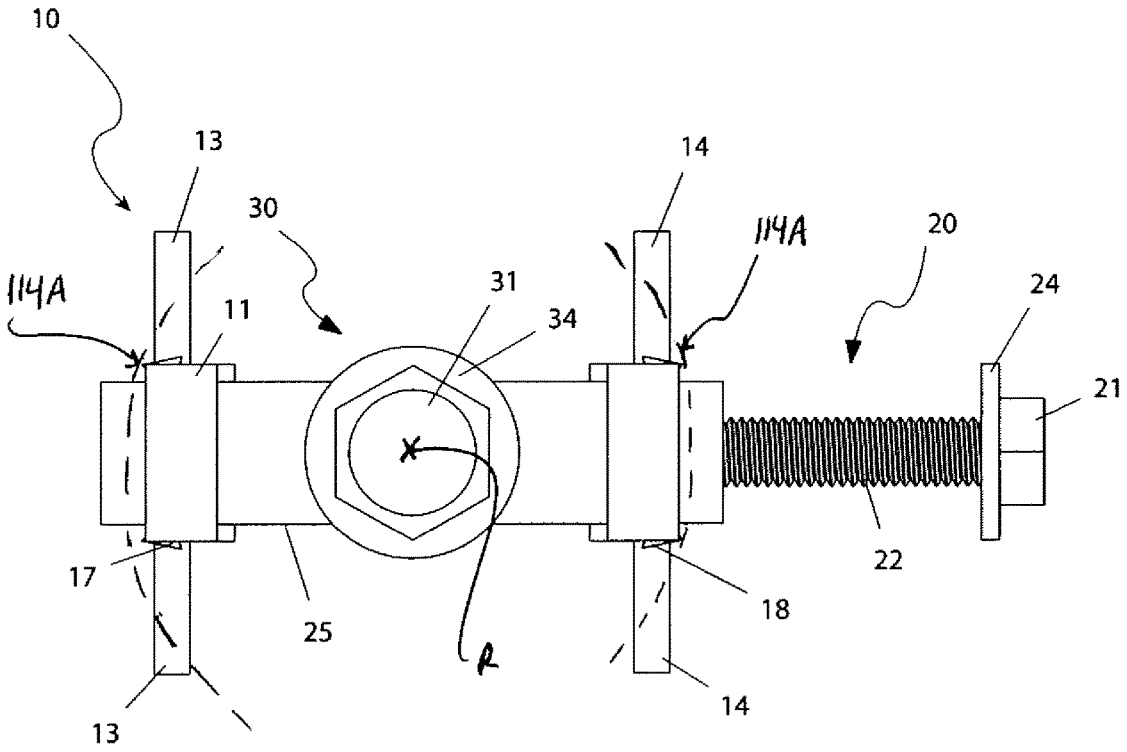
FIG. 7 is a top plan view of the drain extractor tool of FIG. 1.
Figure 8:
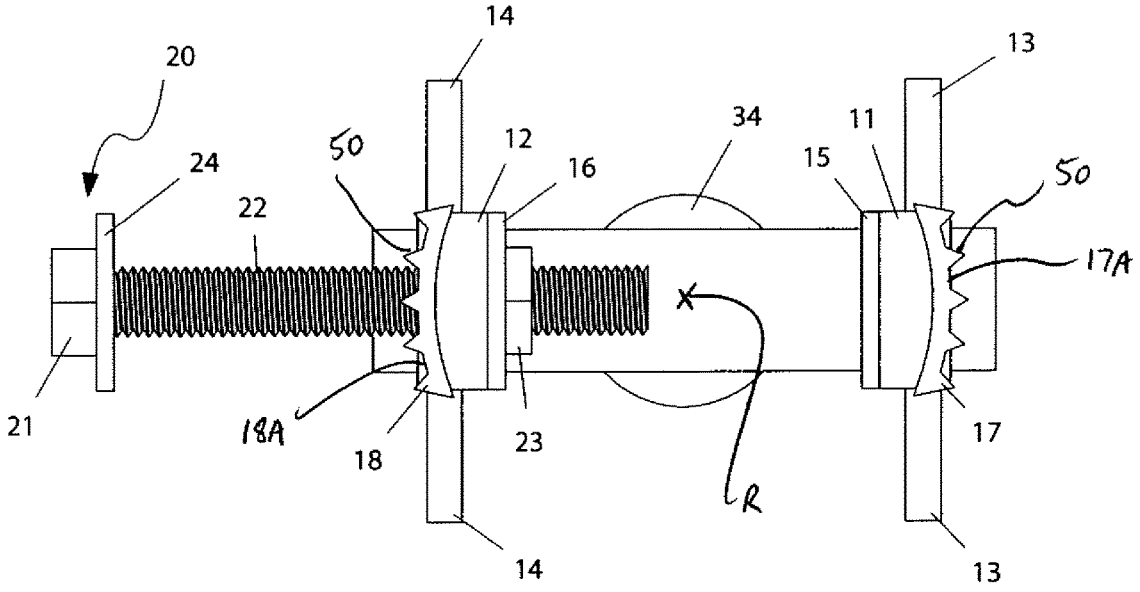
FIG. 8 is a bottom plan view of the drain extractor tool of FIG. 1.

Referring now to FIGS. 1-8, various views of the drain extractor tool 10, are herein illustrated. The tool 10 (as it is described hereafter) includes a hardened steel assembly of disparate parts and preferably coated with a powder coating to provide added protection, resiliency, and waterproof properties. The overall size of the tool 10 is preferably six inches (6 in.) in height and 3 inches (3 in.) in width.

The tool 10 includes a first leg 11 and a second leg 12, each coextensive with each other in length, width, and thickness. The first leg 11 and second leg 12 are planar elements each with a first end and a second end. The second ends of each leg 11, 12 terminate in a semicircular shape. A bridge 25 spans the distance between the first leg 11 and second leg 12 at the first ends thereof. The bridge 25 enables the first ends of the first leg 11 and second leg 12 to travel thereon. Attached to a center top surface of the bridge 25 is a second bolt 30. The second bolt 30 includes a second bolt head 31 capable of receiving a driving tool and a second bolt washer 34. In a preferred embodiment, the second bolt 30 is affixed to the bridge 25.

Located at the second end of the first leg 11 is a first grip 17 that is capable of providing a solid and non-slip grip to a side portion of a drain. Similarly, located at the second end of the second leg 12 is a second grip 18, capable of functioning in a similar manner as the first grip 17. The first grip 17 and second grip 18 are fashioned as a barbed surface to facilitate a non-slipping grip. Located immediately superjacent to the first grip 17 is a first guide 15. The first guide 15 is located on an inner side (i.e., the side facing the second leg 12) and has a width coextensive with the width of the first leg 11. In certain embodiments, the first guide 15 is formed with the first leg 11. The first guide 15 has a rounded leading edge such that the cross-section thereof is semicircular. Similarly located immediately superjacent to the second grip 18 is a second guide 16. The second guide 16 is located on an inner side (i.e., the side facing the first leg 11) and has a width coextensive with the width of the second leg 12. In certain embodiments, the second guide 16 is formed with the second leg 12. The second guide 16 has a rounded leading edge such that the cross-section thereof is semicircular. The first guide 15 and second guide 16 provide smooth transitioning of travel when the tool 10 is inserted into the drain and is able to contact the surface of the drain and help direct the abutment force of the tool 10 with the grips 17, 18 onto the drain.

Extending perpendicularly away from the sides of the second end of the first leg 11, roughly at the same vertical alignment as the first guide 15 are a pair of first flanges 13. Similarly provided, the tool 10 also includes a pair of second flanges 18, extending perpendicularly away from the sides of the second end of the second leg 12, and also roughly at the same vertical alignment as the first guide 15 are a pair of first flanges 13. The pair of first flanges 13 and the pair of second flanges 14 provide a downward limit of travel of the tool 10 (particularly the first grip 17 and second grip 18) when installing in the drain to remove the drain nut. The pair of first flanges 13 and pair of second flanges 14 are adapted to rest on top of the bottom surface of the basin adjacent to the drain and/or rest on top of the drain nut that us to be removed.

A first bolt 20 is removably attached to an aperture **19*b* of the second leg 12. The aperture 19*b* is located superjacent to the second guide 16. The first bolt 20 includes a first bolt head 21 capable of receiving a driving tool, a first bolt shaft 22 extending away from the first bolt head 21 and capable of interacting with the aperture 19*b*, and a first washer 24 located on a side of the second leg 12 not facing the first leg 11 and not capable of passing through the aperture 19*b*. The driving tool is capable of driving the first bolt shaft 22 towards or away from the first leg 11 as the first bolt shaft 22 engages the aperture 19*b*. Located on the first leg 11 and vertically aligned with the aperture 19*b* is a bore 19*a*. The bore 19*a* receives the distal end of the first bolt shaft 22. The first leg 11 may move along the bridge 25 when the first bolt 20 contacts the bore 19*a* of the first leg 11 to motion the first leg 11 relative to the second leg 12 to a desired position. A nut 23 is removably attached to the first bolt shaft 22 on the opposing side of the second leg 12 from the first washer 24 (i.e., the side facing the first leg 11) and is capable of securing the desired position of the second leg 12 relative to the first leg 11**.

The preferred embodiment of the present invention can be utilized by the common user in a simple and effortless manner with little or no training. It is envisioned that the device 10 would be constructed in general accordance with FIG. 1 through FIG. 8. The user would procure the device 10 from conventional procurement channels such as discount stores, hardware stores, plumbing supply stores, mail order and internet supply houses and the like.

Upon use, the first grip 17 and second grip 18 of the tool 10 is placed on top of the drain nut and forced downward until a natural stop occurs or until the pair of first flanges 13 and second pair of flanges 14 contact the inner surface of the bottom of the basin. The first bolt 20 is then mechanically motioned towards the bore **19*a* of the first leg 11 until a firm and secure contact of the tool 10 against the drain nut is accomplished by driving the first leg 11 thereagainst. This can be accomplished with a driving tool such as a wrench on the first bolt head 21. The nut 23 can then be motioned towards the second leg 12 in order to secure this positioning of the tool 10. Either the same or a new wrench can then contact the second bolt head 31 and mechanically motion the entire tool 10 and gripped drain nut in a rotating motion until the drain nut is broken free from the drain of the basin. If the tool 10 slips away from the drain nut or if the tool 10 rotates and the drain nut does not, the tool 10 can easily be repositioned according to the aforementioned steps. The pair of first flanges 13 and pair of second flanges 14** aid in protecting the surface of the basin from marring or scratches.

Figure 9:
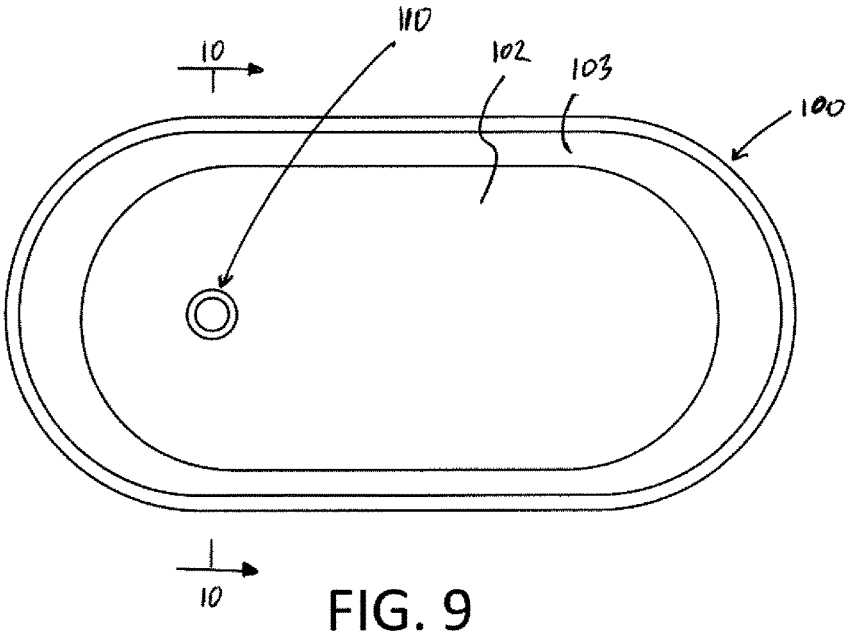
FIG. 9 is a top plan view of a basin.
Figure 10:
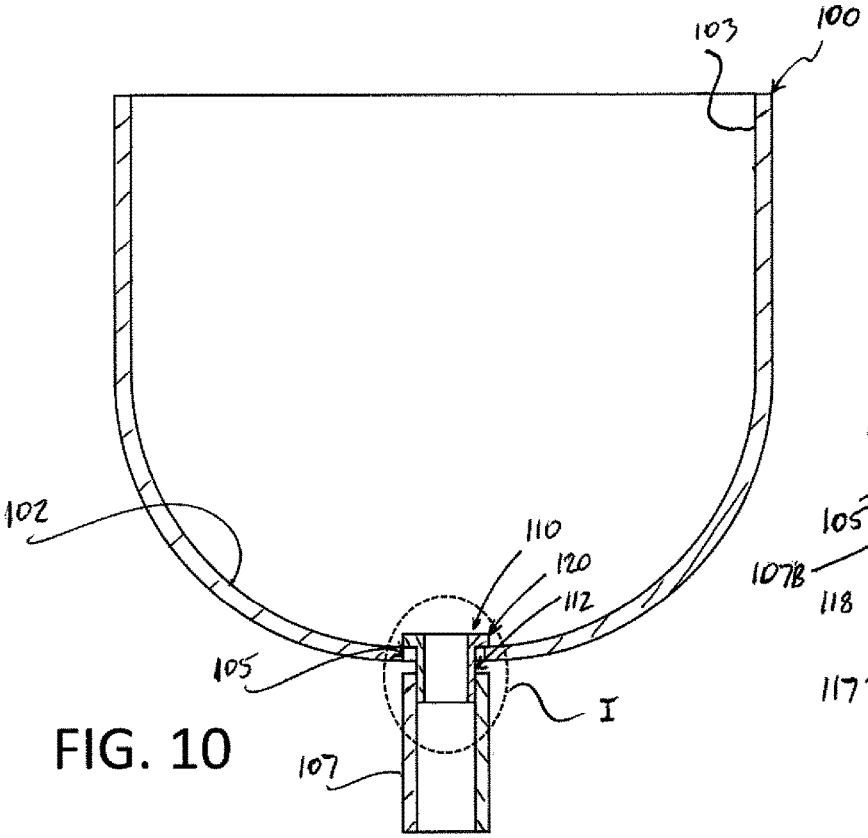
FIG. 10 is a cross-sectional view along line 10-10 in FIG. 9.
Figure 11:
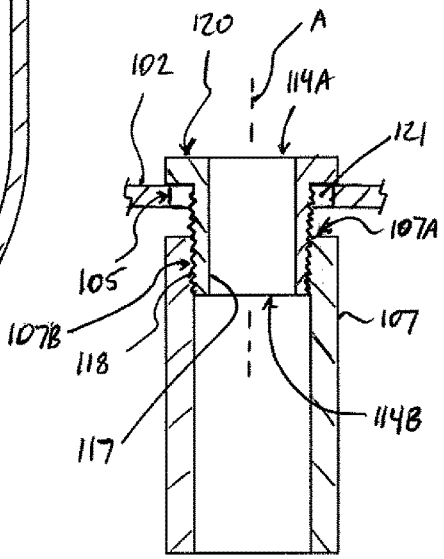
FIG. 11 is an enlarged view of the area indicated at I in FIG. 10.

As described hereinbefore, the present invention relates to a device for removing a drain mounted in a basin. Generally speaking, and with reference to FIGS. 9-11, a liquid-receiving basin 100 (schematically shown) has a bottom wall 102 and a peripheral wall 103 standing upwardly therefrom. The bottom and peripheral walls 102, 103 collectively define a volume for containing liquid. A drain opening 105 is located in the bottom wall 102, usually at a lowest point or elevation thereof, for gravitationally releasing liquid from the basin. An open upper end 107A of a drain pipe 107 (schematically shown) is registered with the drain opening 105 for fluidic communication with the basin's interior volume. The drain pipe 107 extends from the drain opening 105 to gravitationally guide the liquid away from the basin.

A drain 110 (schematically shown), which fluidically interconnects the basin 100 and the drain pipe 107, comprises a tubular portion 112 extending axially, along a central axis A, from a first open 114A end to a second open end 114B and configured for inserting into the drain pipe 107. Typically, the tubular portion 112 is substantially circular cylindrical in shape and has a smooth interior wall 117 and a threaded outer wall 118 for threadably connecting to an inside of the drain pipe 107, that is an inner wall 107B thereof, which is also threaded, at least in proximity to the open end 107A.

The drain 110 further includes a rim portion 120 which forms an annular flange at one end of the tubular portion, in this case that indicated at 114A, to bridge and close an annular gap 121 between the drain pipe 107 and the drain opening 105. Typically, the drain 110 also includes a plug (not shown) which is supported on a threaded shaft coaxially of the drain's tubular portion on criss-crossing members spanning transversely of the tubular portion.

Turning now to the device 10, and with reference to FIGS. 1-8, the device 10 comprises a pair of legs 11, 12 each extending longitudinally from a first end 11A, 12A to a second end 11B, 12B. As more clearly shown in FIGS. 3 and 4, the legs 11, 12 are substantially parallel to one another and laterally spaced-apart to be located on either side of a central rotational axis R.

It will be appreciated that, in the illustrated arrangement, the legs are linear elements in that they extend along a linear path between their opposite ends.

The device 10 further includes a bridging member 25 oriented crosswise to the rotational axis R and extending in a lateral direction to interconnect the legs 11, 12.

For purposes of insertion into the drain 110, each of the legs 11, 12 is movably supported on the bridging member 25 at a location thereon spaced from the second end 11B or 12B, so as to be movable relative thereto and to one another in the lateral direction. In the illustrated arrangement, the legs 11, 12 are slidably movably supported on the bridging member.

Despite the movability of the legs along the bridge 25, the bridging member has a polygonal cross-section and each of the legs has an opening 40, 41 sized and shaped to matingly receive the bridging member 25 such that relative rotation between the leg and the bridging member is resisted. For example, the bridging member has a rectangular-shaped cross-section, as in the illustrated arrangement.

To facilitate rotation of the device, a coupling member 30 is carried on the bridging member 25 at a location registered with the rotational axis R and configured for connecting to a rotary hand tool, for example a screw driver or a ratchet.

The legs 11, 12 comprise end portions, which are indicated at 17 and 18, defining the second ends 11B, 12B thereof and configured for insertion into the drain. The end portions 17, 18 comprise outer sides 17A, 18A each facing away from an opposite one of the legs and configured to engage the inside wall 107B of the drain 110. In the illustrated arrangement, each of the outer sides 17A, 18A of the end portions of the legs is convexly rounded between opposite sides of the leg 11C, 12C which span between the first and second ends 11A/11B and 12A/12B.

The device 10 further includes a plurality of stabilizers 13, 14 attached in fixed relation to the legs 11, 12 and extending outwardly therefrom in opposite directions crosswise to the longitudinal and lateral directions. The stabilizers 13, 14 are configured to rest on a surface interior to the basin 100 when the end portions 17, 18 of the legs are inserted into the drain 110. For example, bottoms or undersides of the stabilizers, in proximal relation to the leg second ends 11B, 12B, are rested against an upper surface 120A of the rim portion of the drain encompassing the drain opening 114A, as represented by stippled line in FIG. 3 and FIG. 7. Thus, the legs 11, 12 can be maintained in substantially parallel orientation to the axis A of the drain. In the illustrated arrangement, there are a pair of the stabilizers 13, 14 on each of the legs and projecting in opposite directions therefrom.

Furthermore, the device 10 includes a biasing member 20 carried between the legs 11, 12 and configured to urge the legs laterally apart to locate the outer sides 17A, 18A of the end portions of the legs into butting engagement with the inside wall 107B of the drain. In the illustrated arrangement, the biasing member 20 is threadably carried on a first one of the legs, in this case that at 12, for movement relative thereto in the lateral direction to selectively engage an opposite one of the legs, in this case that at 11. Furthermore, in the illustrated arrangement, the opposite leg 11 comprises a recess 19A on an inner side thereof facing the first leg 12 and arranged to snugly receive an end of the biasing member 20 to resist relative movement when the biasing member is selectively engaged with the opposite leg.

To improve engagement between the outer sides 17A, 18A of the end portions with the drain, the interior wall 117 of which is smooth, the end portions 17, 18 of the legs comprise a plurality of spaced-apart longitudinally-extending ridges 50 configured for gripping the inside wall of the drain.

In yet other words, the present invention relates to a device for removing a drain in a basin, which comprises a pair of legs in parallel spaced relation on either side of a rotational axis, a bridging member interconnecting the legs which are movably supported thereon, and a coupling member carried on the bridging member and configured for connecting to a rotary hand tool. The legs comprise end portions configured for insertion into the drain, and the end portions comprise outer sides configured to engage an inside wall of the drain. Stabilizers are affixed to the legs and extending outwardly therefrom in opposite directions and configured to rest on a surface interior to the basin when the end portions of the legs are inserted into the drain. A biasing member is carried between the legs and configured to urge them laterally apart to locate the outer sides of the end portions into butting engagement with the inside wall of the drain.

This arrangement provides a relatively simple tool for removing or extracting a drain by engaging an inside wall thereof.

The scope of the claims should not be limited by the preferred embodiments set forth in the examples but should be given the broadest interpretation consistent with the specification as a whole.

The invention claimed is:

1. A device for removing a drain mounted in a basin, comprising:

a pair of legs each extending longitudinally from a first end to a second end, wherein the legs are substantially parallel to one another and laterally spaced-apart to be located on either side of a central rotational axis;

a bridging member oriented crosswise to the rotational axis and extending in a lateral direction to interconnect the legs;

wherein each of the legs is movably supported on the bridging member at a location thereon spaced from the second end, so as to be movable relative thereto and to one another in the lateral direction;

a coupling member carried on the bridging member at a location registered with the rotational axis and configured for connecting to a rotary hand tool;

wherein the legs comprise end portions defining the second ends thereof and configured for insertion into the drain;

wherein the end portions comprise outer sides each facing away from an opposite one of the legs and configured to engage an inside wall of the drain;

a plurality of stabilizers attached in fixed relation to the legs and extending outwardly therefrom in opposite directions crosswise to the longitudinal and lateral directions, wherein the stabilizers are configured to rest on a surface interior to the basin when the end portions of the legs are inserted into the drain; and a biasing member carried between the legs and configured to urge the legs laterally apart to locate the outer sides of the end portions of the legs into butting engagement with the inside wall of the drain.

2. The device of claim 1 wherein the legs are slidably movably supported on the bridging member.

3. The device of claim 2 wherein the bridging member has a polygonal cross-section and each of the legs has an opening sized and shaped to matingly receive the bridging member such that relative rotation between the leg and the bridging member is resisted.

4. The device of claim 1 wherein the end portions of the legs comprise a plurality of spaced-apart longitudinally-extending ridges configured for gripping the inside wall of the drain.

5. The device of claim 1 wherein the stabilizers comprise a pair of the stabilizers on each of the legs and projecting in opposite directions therefrom.

6. The device of claim 1 wherein the biasing member is threadably carried on a first one of the legs for movement relative thereto in the lateral direction to selectively engage an opposite one of the legs.

7. The device of claim 6 wherein the opposite leg comprises a recess on an inner side thereof facing the first leg and arranged to snugly receive an end of the biasing member to resist relative movement when the biasing member is selectively engaged with the opposite leg.

8. The device of claim 1 wherein each of the outer sides of the end portions of the legs is convexly rounded between opposite sides of the leg which span between the first and second ends thereof.

* * * * *